US011426788B2

(12) United States Patent
Meschut et al.

(10) Patent No.: US 11,426,788 B2
(45) Date of Patent: Aug. 30, 2022

(54) METHOD FOR JOINING AT LEAST ONE COMPONENT TO A SECOND COMPONENT WITHOUT PREFORMED HOLE(S)

(71) Applicant: NEWFREY LLC, New Britain, CT (US)

(72) Inventors: Gerson Meschut, Giessen (DE); Christian Reis, Giessen (DE)

(73) Assignee: Newfrey LLC, New Britain, CT (US)

( * ) Notice: Subject to any disclaimer, the term of this patent is extended or adjusted under 35 U.S.C. 154(b) by 0 days.

(21) Appl. No.: 16/364,826

(22) Filed: Mar. 26, 2019

(65) Prior Publication Data

US 2019/0217374 A1 Jul. 18, 2019

Related U.S. Application Data

(63) Continuation of application No. PCT/EP2017/074408, filed on Sep. 26, 2017.

(51) Int. Cl.
*B21J 15/02* (2006.01)
*B21J 15/04* (2006.01)
(Continued)

(52) U.S. Cl.
CPC ..... *B21J 15/025* (2013.01); *B21J 15/048* (2013.01); *B21J 15/08* (2013.01); *H05B 7/18* (2013.01); *B21J 15/12* (2013.01)

(58) Field of Classification Search
CPC ..... B21J 15/025; B21J 15/048; B21J 15/08; B21J 15/12; H05B 7/18
See application file for complete search history.

(56) References Cited

U.S. PATENT DOCUMENTS 4,528,436 A * 7/1985 Stol ..... B23K 9/0282 219/61
5,095,828 A * 3/1992 Holden ..... F23G 5/10 110/235
(Continued)

FOREIGN PATENT DOCUMENTS

CN 1955497 A 5/2007
CN 203245496 U 10/2013
(Continued)

OTHER PUBLICATIONS

International Search Report dated Jan. 16, 2018.
(Continued)

*Primary Examiner* — Lawrence Averick
(74) *Attorney, Agent, or Firm* — Harness, Dickey & Pierce, P.L.C.

(57) ABSTRACT

A joining method for connecting a first component to a second component without pre-punching. The first component and the second component are positioned relative to one another prior to the connection by an auxiliary joining element, which is joined via a joining device to the components positioned relative to one another. The auxiliary joining element firstly passes through the first component without pre-punching and is then connected to the second component without pre-punching. Before the components are connected by the auxiliary joining element, the first component is thermally pre-treated at the joining area via an electric arc formed between the first component and an electrode of the joining device. A heat-affected zone is formed on the first component in the joining area, and the first component in is weakened or melted in the heat-affected zone.

23 Claims, 13 Drawing Sheets

(51) Int. Cl.

| | |
|---|---|
| ***B21J 15/08*** | (2006.01) |
| ***B21J 15/12*** | (2006.01) |
| ***H05B 7/18*** | (2006.01) |

(56) References Cited

U.S. PATENT DOCUMENTS

| | | | | |
|---|---|---|---|---|
| 6,417,490 | B1 | 7/2002 | Liebrecht et al. | |
| 6,836,948 | B2 * | 1/2005 | Wang | B21J 15/08 411/181 |
| 7,937,816 | B2 | 5/2011 | Droulez | |
| 9,352,377 | B2 | 5/2016 | Smeyers | |
| 10,099,423 | B2 | 10/2018 | Wang | |
| 10,589,374 | B2 | 3/2020 | Draht | |
| 2004/0148760 | A1 | 8/2004 | Wang | |
| 2013/0133173 | A1 | 5/2013 | Ahlborn et al. | |
| 2014/0331478 | A1 | 11/2014 | Dannheisig | |
| 2015/0144602 | A1 * | 5/2015 | Draht | B23K 20/02 228/141.1 |
| 2015/0266269 | A1 * | 9/2015 | Haack | B32B 7/12 156/92 |
| 2015/0290914 | A1 | 10/2015 | Campbell et al. | |
| 2016/0332214 | A1 | 11/2016 | Hornbostel et al. | |
| 2016/0332215 | A1 * | 11/2016 | Blacket | H02K 41/02 |
| 2017/0021389 | A1 * | 1/2017 | Haack | B05D 1/62 |
| 2017/0044637 | A1 * | 2/2017 | Campbell | C21D 1/40 |

FOREIGN PATENT DOCUMENTS

| | | | | |
|---|---|---|---|---|
| CN | 103796773 | A | 5/2014 | |
| CN | 104023869 | A | 9/2014 | |
| CN | 104540628 | A | 4/2015 | |
| CN | 105188986 | A | 12/2015 | |
| CN | 105922562 | A | 9/2016 | |
| DE | 19630488 | A | 1/1998 | |
| DE | 19634417 | C | 3/1998 | |
| DE | 102008058917 | A | 5/2010 | |
| DE | 102010006400 | A1 * | 8/2011 | B21J 15/025 |
| JP | 2006007266 | A | 1/2006 | |
| WO | 2015107350 | A1 | 7/2015 | |

OTHER PUBLICATIONS

Electrode; Wikipedia; https://en.wikipedia.org/wiki/Electrode; last edited Sep. 23, 2021.

Difference Between Transferred Arc and Non-Transferred Arc Plasma Torch; Wikipedia; http://www.difference.minaprem.com/ntm/difference-between-transferred-arc-and-non-transferred-arc-plasma-torch/; retrieved on or about Jan. 27, 2022.

List of welding processes; Wikipedia; https://en.wikipedia.org/w/index.php?title=List_of_welding_processes&oldid=1030145145; last edited Jun. 24, 2021.

Office Action dated Aug. 5, 2021 in corresponding Chinese Patent Application No. 201780059239.8.

* cited by examiner

METHOD FOR JOINING AT LEAST ONE COMPONENT TO A SECOND COMPONENT WITHOUT PREFORMED HOLE(S)

CROSS-REFERENCE TO RELATED APPLICATION

This application is a continuation of international application PCT/EP2017/074408, filed Sep. 26, 2017 which claims priority from German Patent Application No. 102016118109.9 filed Sep. 26, 2016, the disclosures of which are incorporated herein by reference in their entirety.

BACKGROUND OF THE INVENTION

The invention relates to a method for joining at least one component to a second component without pre-formed (for example pre-drilled or pre-punched) hole or holes in the components prior to the joining. More particularly the present invention is directed to a method for joining a first and a second component with an auxiliary joining element, wherein the auxiliary joining element is actuated by a joining device toward the first component along a joining axis, the auxiliary joining element firstly passing through the first component in the region of a joining area without pre-formed hole and then reaching the second component in the region of a joining area without pre-formed hole.

It is known from the state of the art to join two components made from a conventional material, for example conventional steel of customary strength, without pre-formed hole, for example by clinching, resistance welding, punch riveting or direct screwing. Joining methods for components without pre-formed holes are however limited to components of conventional strength, since the maximum forces for such joining devices are reduced and they are not able to pierce or penetrate any kind of material or the strength of the joining elements may not be sufficient.

Recently, in particular in the automotive industry, the use of high-strength material has been gradually increased as economy in automotive fuel consumption as well as passenger safety during automobile collisions are increasingly required.

Document DE 10 2016 115 463.6 discloses a method for joining two components, one of the component being made in a high-strength material with a very high rigidity. High-strength materials of this type are nowadays used typically in automotive engineering so as to provide a light-weight assembly with an increased passive safety and good properties in a crash test. A typical material can be, for example, 22MnB5 with a strength of approximately 1,500 MPa. The joining method disclosed in DE102016115463.6 comprises the manufacture of a pre-hole by means of an electric arc produced between the high-strength material and an electrode and the joining of the two components by guiding an auxiliary joining part through the pre-hole and connecting it to the second component. Although this method is satisfactory, the step of pre-punching or pre-forming a hole may be time consuming and may imply a risk that the two components will lose their relative position between the step of forming the hole and the step of joining the component.

BRIEF SUMMARY OF THE INVENTION

The object of the present invention is to develop a joining method, without pre-forming a hole, for connecting two components, such that at least one high-strength material component can be connected to a second component without pre-forming any hole or pre-punching.

Accordingly, the present invention provides a method for joining at least one component to a second component without pre-formed hole(s) comprising the steps of:

a. Providing a first and a second component, the first and the second components being at least partly positioned one on top of the other, the first component being made in a high-strength material;

b. Providing a joining device and an auxiliary joining element;

c. Joining the first and second component together by means of the auxiliary joining element, wherein the auxiliary joining element is actuated by the joining device toward the first component along a joining axis, the auxiliary joining element firstly passing through the first component in the region of a joining area without pre-formed hole and then reaching the second component in the region of a joining area without pre-formed hole, characterized in that prior to the joining, the first component in the region of the joining area is heat-treated via an electric arc, which is formed between the first component on the one hand and an electrode provided on the joining device on the other hand, in such a way that a heat-affected zone is formed on the joining area of the first component, and in that the first component is heated in such a way that a strength of the first component in the heat-affected zone is reduced.

Thus, before the connection between the first and second components, the first component is thermally pre-treated locally in the region of the joining areas via an electric arc, which is formed between the first component on the one hand and an electrode of the joining device on the other hand, in such a way that a heat-affected zone is formed in the joining area in any case on the first component, in which heat-affected zone the first component is heated, such that a strength of the first component in the heat-affected zone is reduced and/or the first component is melted in the heat-affected zone. The method is performed in such a way that the first and the second component are positioned relative to one another. The method according to the invention may allow a one-sided access. Thus, the joining of two or more component does not require an access on both sides of the joining. The second component is not separated. In other words, the components are completely joined together with the joining device accessing a side of the first component at the joining area and without requiring access at the joining area to a side of the second component opposite the first component (e.g., at the joining area on the side from which the free distal end of the auxiliary joining element extends outwardly in FIGS. 4 and 8, which is the bottom side as oriented in these figures). Different materials can be joined together. For example, the first component may be made from steel wherein the second component is made from aluminium, or the contrary. The auxiliary joining element may be made in various materials.

This provides the advantage that, due to the selective reduction of the strength of the first component, which is produced with high-strength material, in the heat-affected or joining zone or area, the auxiliary joining element can be guided through the first component and connected to the second component without the need to produce a pre-hole in first component and optionally additionally in the second component and/or without the joining forces being inadmissibly high. The joining process is simplified hereby, since in particular the process step of pre-drilling or punching a hole is spared and a change in position of the components between the production of the pre-punch and the connection of the components is prevented as an intrinsic part of the method. By way of example, a nail, a bolt, a half-hollow punch rivet or an FDS screw may be used as auxiliary joining element.

In the context of the invention, reference is made to a high-strength material whenever the strength at room temperature is at least 600 MPa.

An electric arc in the sense of the invention can be a transferred electric arc or a non-transferred electric arc (plasma jet).

In a preferred embodiment, the electric arc is formed annularly around the joining axis.

In a preferred embodiment the electric arc surrounds the auxiliary joining element on its outer lateral side. For example, the auxiliary joining element comprises a cylindrical body and the electrical arc encompasses at least partly the cylindrical body.

In a preferred embodiment, protective gas is fed via a protective gas nozzle arranged on the joining device during heat-treating of the first component. The protective gas is used in order to produce the electric gas. The protective gas protects the (non-consumable) electrode and/or the melt against oxidation influences.

In a preferred embodiment the protective gas nozzle is annular and/or comprises openings facing the first component, at a distance therefrom. For example, the protective gas nozzle surrounds the electric arc or the electrode.

In a preferred embodiment the auxiliary joining element is driven via a joining punch along the joining axis. If a sufficient softening or melting of the first component in the heat-affected zone is then attained, the auxiliary joining element is introduced into the heat-affected zone via the joining punch.

In a preferred embodiment the auxiliary joining element is rotated around the joining axis (4) during the joining step.

In a preferred embodiment, a die is pressed against the second component in the region of the joining area during the joining step. By pressing the die against the second component, a deformation of the first component and/or of the second component during the joining process can be advantageously prevented. The die in this respect absorbs the joining forces exerted via the joining stamp onto the auxiliary joining part during the joining process.

In a preferred embodiment, the die is arranged coaxially to the auxiliary joining element.

In a preferred embodiment the electrode is a disposable electrode. For example, the electrode is an annular electrode. The electrode may also be a non-consumable electrode, which can be reused several times.

The electrode may be arranged above the first component and above a joining area intended for connection of the components. The auxiliary joining element is fed within the non-consumable electrode and is fixed under a joining stamp or punch adjustable in the direction of a joining axis. The joining stamp can perform in particular linear movements in translation and optionally additionally rotary movements. Both movements can be superimposed during the joining process.

An electric arc is ignited between the upper component (or first component) and the non-consumable (or disposable) electrode. In particular, a plasma arc (plasma jet), which burns between the electrode components is provided. A non-transferred electric arc, in which the first component is not part of the electric circuit, may also be implemented. The thermal energy fed to the first component via the electric arc heats the first component (and optionally the second component) in such a way that a strength of the first component (and optionally a strength of the second component) is (are) reduced. For example, a melt can be produced locally on the first component in the heat-affected zone.

In a preferred embodiment the disposable electrode is held by the auxiliary joining element against the first and/or the second component after the joining step.

In a preferred embodiment the auxiliary joining element is guided through the second component. Alternatively, the auxiliary joining element can be guided into the second component, but not through the second component.

In a preferred embodiment the auxiliary joining element is deformed in the second component. In particular, the auxiliary joining element is bent radially outwardly with regard to the joining axis. Due to the shaping and bending of the auxiliary joining element, a seamless connection in particular of the two components is produced by the auxiliary joining element.

In a preferred embodiment, the region of the heat-affected zone is cooled and an integral joining connection is produced between the auxiliary joining element on the one hand and the first component and/or the second component on the other hand.

In a preferred embodiment, the outer lateral side of the auxiliary joining element comprises a pattern, such that a gripping is provided during the joining step in the region of the heat-affected zone of the first component and/or the second component in such a way that a frictionally engaged and/or interlocking connection is produced between the first component and the second component on the one hand and the auxiliary joining element on the other hand. The pattern may be undercuts. For example, the auxiliary joining element and the first component are connected metallurgically in an integrally bonded manner by welding, soldering defects or intermetallic phases.

In a preferred embodiment, prior to the joining step, the second component is heated by means of an electric arc in a heat-affected zone of the second component, wherein the electric arc is ignited with the second component and a further electrode in such a way that the strength of the second component in the heat-affected zone of the second component is reduced and/or the second component is melted in the heat-affected zone.

By providing on the one hand the electrode associated with the first component and on the other hand the further electrode associated with the second component, two high-strength components advantageously can be connected without pre-punching. For this purpose, each of the two components is heated in the heat-affected zone and as a result of the heating the strength of both components is reduced locally, or a melt is produced locally, so that the auxiliary joining element can be guided through the first component and can be connected to the second component with a small application of force. In this respect, it can be provided that the auxiliary joining element is guided through the second component or is guided into the second component without having to be guided through the second component.

If, in addition to the reduction of the strength of the first component, the second component is also heated, the strength of the second component is reduced, the joining force to be applied in order to introduce the auxiliary joining element can be reduced further, with the result that in particular the process can be accelerated or the cycle time can be increased and/or the joining forces can be reduced.

In a preferred embodiment the electrode associated with the first component and the further electrode associated with the second component are arranged coaxially and/or are arranged opposite one another.

In a preferred embodiment, the electric arc between the electrode and the first component on the one hand and the electric arc between the further electrode and the second component on the other hand are ignited in particular simultaneously or in a manner overlapping in time. The auxiliary joining element can be moved by the joining punch or can be joined to the second component whilst the first electric arc and the second electric arc are ignited and/or extinguished.

Once the joining punch has brought the auxiliary joining element into its end position (i.e. the position, in which a joining of the first and second component may be performed), this is followed by a return stroke of the non-consumable electrode (if a non-consumable electrode is used) and the joining punch. The heat-affected zone cools and the materials regain their high strength. The connection of the first component to the second component via the auxiliary joining element is finally produced.

In accordance with the invention, it can be provided that the heating of the first component and the introduction of the auxiliary joining element are overlapped in time or are performed sequentially.

BRIEF DESCRIPTION OF THE DRAWINGS

Other characteristics and advantages of the invention will readily appear from the following description of embodiments, provided as non-limitative examples, in reference to the accompanying drawings.

DETAILED DESCRIPTION OF THE PREFERRED EMBODIMENTS

Figure 1:
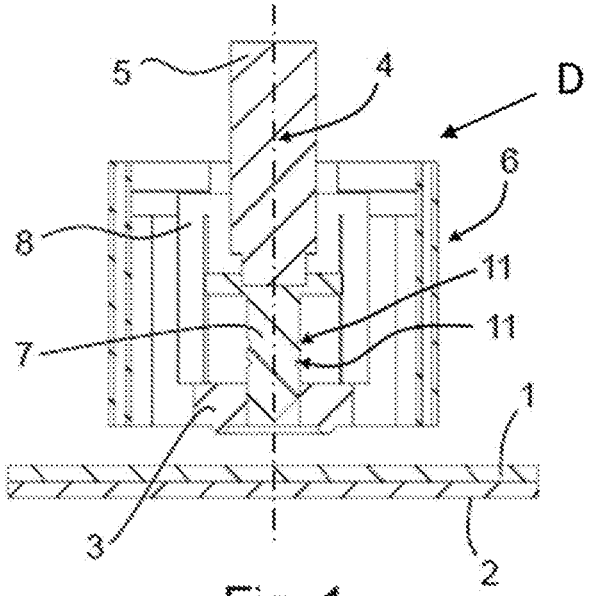
FIG. 1 shows a first step of a method according to a first embodiment of the invention, wherein a first component and a second component are arranged, an auxiliary joining element facing the first component being held by a joining device.

On the different figures, the same reference signs designate identical or similar elements.

FIG. 1 to FIG. 15 show a joining device D adapted to carry out a method for joining a first and a second component 1, 2 together with an auxiliary joining element 7, the first component being made in high-strength material, for example high-strength steel or other high-strength material like carbon-fiber reinforced materials.

The joining device D comprises, as visible in FIG. 1 to FIG. 4, an electrode 3 designed to create an electric arc. As in this embodiment, the electrode can be a single electrode 3. The joining device D further comprises a joining punch 5 adapted to drive or actuate the auxiliary joining element 7 toward the first and second component 1, 2 in order to carry out the joining. The electrode 3 can be an annular electrode 3. The joining punch 5 and the electrode 3 may both be arranged coaxially to a joining axis 4. The joining device may be provided with a protective gas nozzle. A guide 8 may also be provided to guide the auxiliary joining element 7 within the joining device 8, for example along the joining axis 4. The protective gas nozzle 6 and the guide 8 may be arranged coaxially to the joining axis 4.

Alternatively, the electrode 3 may be arranged with an offset with regard to the joining axis. More particularly, the electrode extends along an electrode axis between a first and a second end, and the electrode axis and the joining axis form an angle, the angle being for example between 10 degrees and 85 degrees. The second end of the electrode is arranged proximate the joining area, such that the electrode is adapted to heat the first component, but is not co-axial with the joining punch, such that it does not disturb the joining punch stroke.

The electrode 3 may also be arranged movable in rotation around a rotation axis, the rotation axis being orthogonal to the joining axis. For example, the electrode comprises a first segment and a second segment, the first and second segment forming a non-zero angle, such that the electrode has an elbow shape. The free end of the electrode adapted to face the first component is provided on the second segment, wherein the rotational connection is provided on the first segment. The first segment may be arranged sensibly co-axial to the joining axis for example just below the auxiliary joining element, in order to perform a thermally pre-treatment of the first component 1, and then the electrode may rotate in order to clear the stroke of the auxiliary joining element and/or joining punch. For example, an actuator may be used to move the electrode, or the joining device may be provided with a body adapted to push the electrode away from the stroke of the joining punch, when the auxiliary joining element is translated toward the first component 1.

FIG. 1 to FIG. 4 show the different steps of a joining method according to a first embodiment.

In a first step, as illustrated in FIG. 1, the auxiliary joining element 7 is fixed to the joining punch 5. The electrode 3, the auxiliary joining element 7 and the joining punch 5 are arranged above and at a non-zero distance from the first component 1. As shown, the first component 1 can be positioned closest to the joining device D and the second component can be positioned furthest from the joining device during the heat-treating and the joining by means of the auxiliary joining element 7. The first and second component are not provided with any pre-hole adapted to receive the auxiliary joining element 7. The first component and/or the second component 1, 2 are for example made in high-strength steel.

Figure 2:
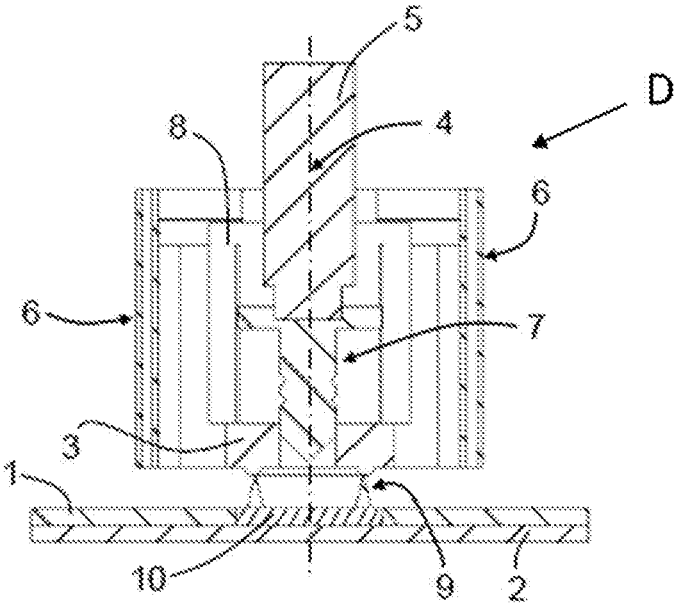
FIG. 2 shows a second step of the method according to the first embodiment, wherein an electrical arc is provided between the first component and an electrode.

In order to carry out the joining of the first and second component 1, 2 with the auxiliary joining element 7, an electric arc 9 is ignited firstly between the first component 1 and the electrode 3 (see FIG. 2). The electric arc 9 forms a heat-affected zone 10 in a joining area on the first component 1. In other words, the heat-affected zone 10 is heated, and as a result of the heating, the strength of the component 1 is reduced. For example, a melt is formed. The electric arc 9 is created in particular under the influence of a protective gas (not shown) fed via the protective gas nozzles 6. The protective gas may protect the electrode 3 or the melt in the heat-affected zone 10 against oxidation influences.

Figure 3:
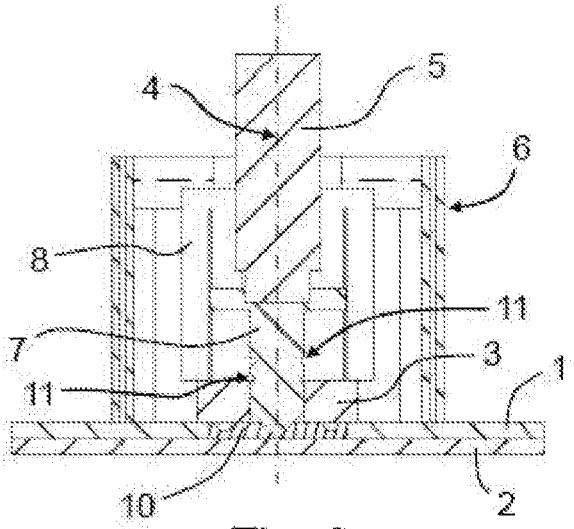
FIG. 3 shows a third step of the method according to the first embodiment, wherein the auxiliary joining element penetrates the first component.

In a subsequent step, illustrated in FIG. 3, the electrode is placed against the first component 1, and the auxiliary joining element 7 is guided linearly by the electrode 3 via the joining punch 5, and is then pressed through the first component 1 toward the second component 2. More particularly, the auxiliary joining element 7 is moved along the joining axis 7, for example by an actuator toward the first and second components 1, 2, and penetrating firstly the first component before penetrating the second component 2. Alternatively, the auxiliary joining element 7 may be guided in translation along the joining axis and in rotation around said joining axis 4. The first component 1, as previously mentioned, is produced from a high-strength material. The joining area of the first component has, as previously disclosed, being weakened in terms of its strength in the region of the heat-affected zone 10, so that the auxiliary joining element 7 can be pressed through the first component 1 with a comparatively low joining force.

In this first embodiment, the electrode 3 is designed in the form of a disposable electrode 3. The disposable electrode 3 is first part of the joining device and then is "released" from the joining device and held by the auxiliary joining element 7 after the joining of the first and second components 1, 2 by the auxiliary joining element 7.

Figure 4:
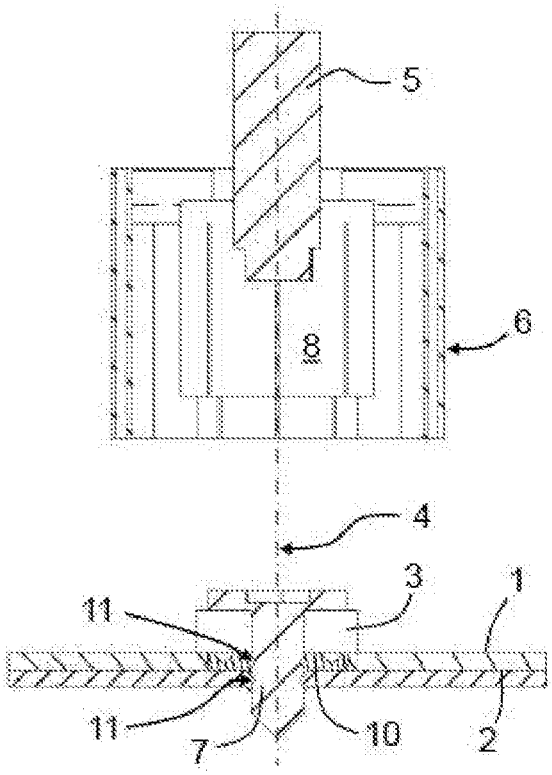
FIG. 4 shows a fourth step of the of the method according to the first embodiment, wherein the joining device is spaced apart from the first and second components, the electrode staying attached to the auxiliary joining element.
Figure 5:
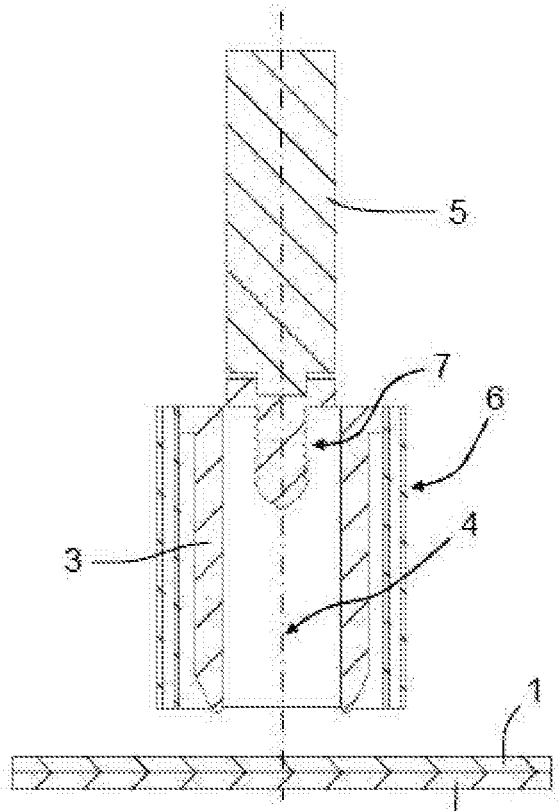
FIG. 5 shows a first step of a method according to a second embodiment of the invention, wherein the first component and the second component are arranged with the auxiliary joining element being held by the joining device comprising an electrode.
Figure 6:
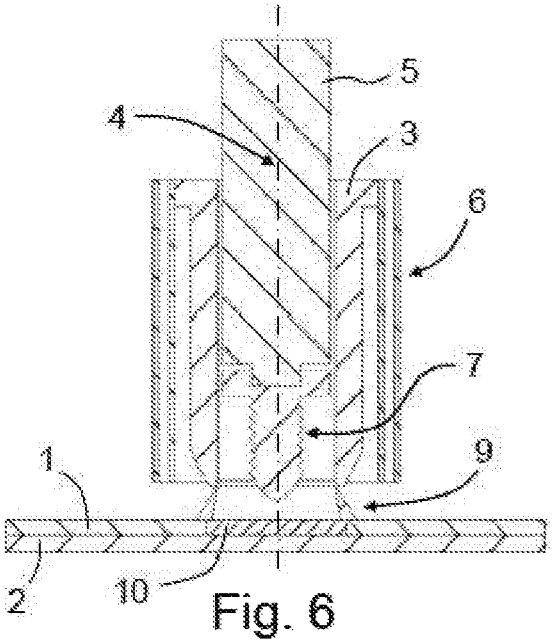
FIG. 6 shows a second step of the method according to the second embodiment, wherein an electrical arc is provided between the first component and an electrode.
Figure 7:
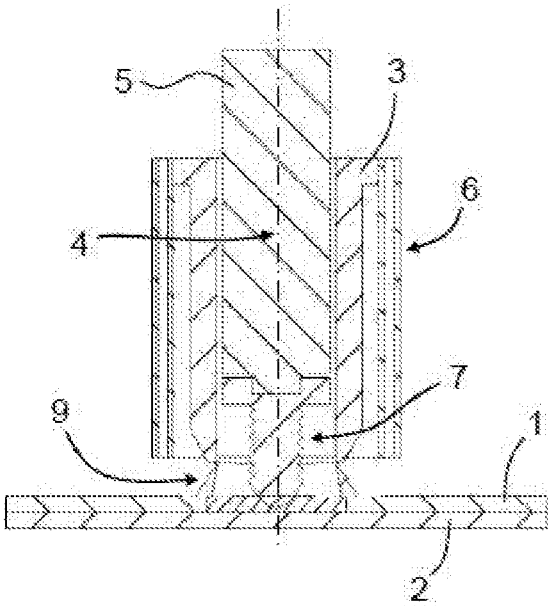
FIG. 7 shows a third step of the method according to the second embodiment, wherein the auxiliary joining element penetrates the first component.

As seen in FIG. 4, the electrode is arranged against the first component 1 once the joining has been performed. Also as seen, the joining with the auxiliary joining element causes the auxiliary joining element 7 to pass through both the first component 1 and the second component 2 such that a free distal end of the auxiliary joining element 7 extends outwardly at the joining area from a side of the second component 2 that is opposite the first component 1. As a result of the forces and temperature acting during the joining process, an integrally bonded connection is created between the component 1 and the disposable electrode 3 (and the auxiliary joining element 7).

The auxiliary joining element may be provided with a pattern. For example, a plurality of peripheral, annular grooves 11 is provided on the auxiliary joining element 7. The annular grooves 11 are provided in the region of the joining area following the production of the connection (i.e. following the joining). The annular grooves 11 are filled completely or in any case partially with the material of the first component 1 and of the second component 2, so that, following the production of the connection and the cooling of the components 1, 2 in the joining area, an interlocking connection is created between both the first component 1 and the second component 2 and the auxiliary joining element 7. As a result of the interlocking connection, a very good retaining force is produced as well as a secure connection of the components 1, 2.

The interlocking connection between the first component 1 and/or the second component 2 and the auxiliary joining element 7 can be superimposed by an integrally bonded connection between the first component 1 and the second component 2 and/or the first component 1 and the auxiliary joining element 7 and/or the second component 2 and the auxiliary joining element 7.

Due to the production of the integrally bonded connection, in particular in the heat-affected zone 10 and edge regions thereof, the connection of the components 1, 2 and of the auxiliary joining element 7 is further improved, with the result that the connection (or joining) of the high-strength component 1 to the second component 2 is reliable. Hence, no pre-hole is needed.

In order to promote the interlocking connection between the second component 2 and the auxiliary joining element 7, an embossing ring can be provided in a variant of the invention. The embossing ring is pressed against the second component 2 opposite the electrode 3 or the auxiliary joining element 7 and the joining punch 5. The embossing ring cooperates with the second component 2, so that, when producing the connection, the material of the second component 2 is locally displaced by the embossing ring, and the annular groove 11, which is provided in the region of the second component 2 after the joining process, is filled with the material of the second component 2. The embossing ring by way of example can be provided separately as a replaceable part of the joining device or together with a die.

FIG. 5 to FIG. 8 illustrates a second embodiment of the present invention. In this embodiment, the auxiliary joining element 7 is fed (or actuated by the joining device) in a combined linear movement in translation and rotary movement, along or around on the joining axis 4. The electric arc 9 is formed in a known manner between the electrode 3, which is formed as a non-consumable electrode 3, and the first component 1. The electric arc 9 "burns" under the influence of a protective gas provided via the protective gas nozzle 6.

Figure 8:
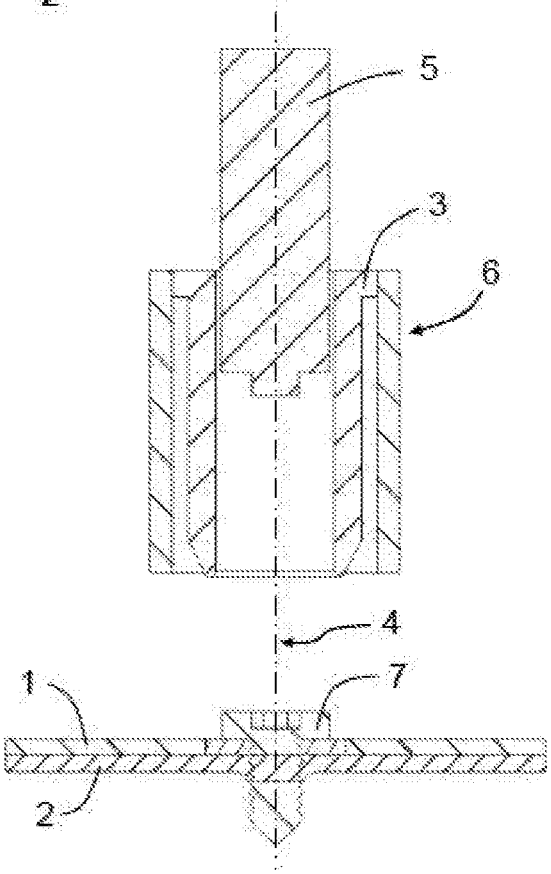
FIG. 8 shows a fourth step of the method according to the second embodiment, wherein the joining device is spaced apart from the first and second components, the joining between the first and second components being done.
Figure 9:
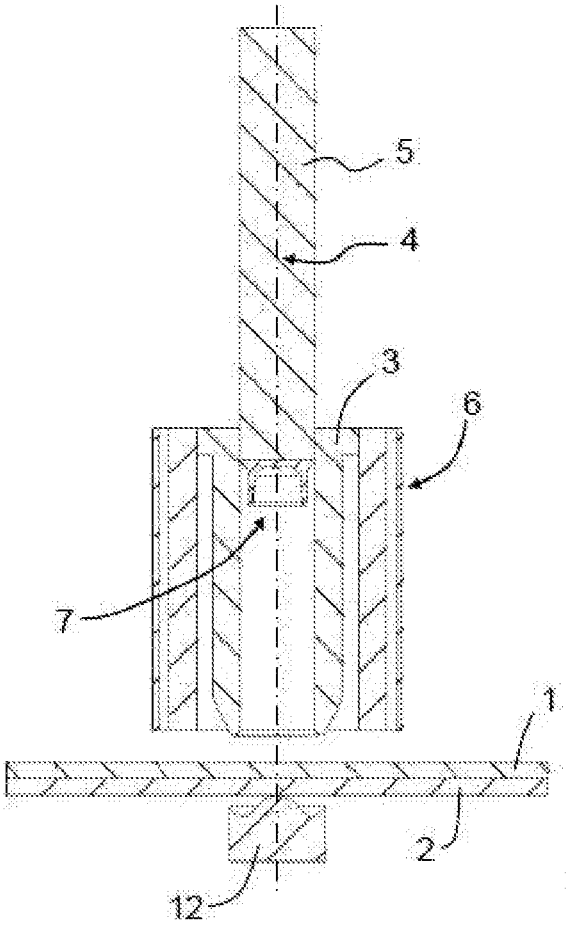
FIG. 9 shows a first step of a method according to a third embodiment of the invention, wherein the auxiliary joining element is a self-piercing rivet, and wherein a die is provided.
Figure 10:
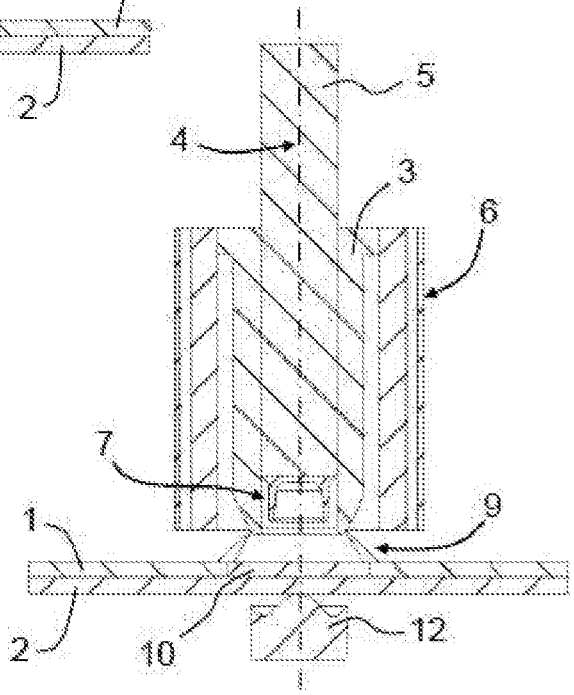
FIG. 10 shows a second step of the third embodiment, wherein an electrical arc is provided between the first component and an electrode.
Figure 11:
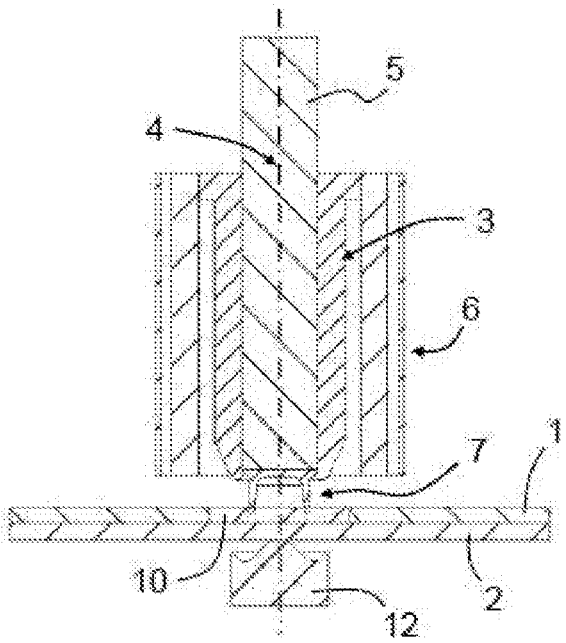
FIG. 11 shows a third process step of the third embodiment, wherein the auxiliary joining element penetrates the first component.
Figure 12:
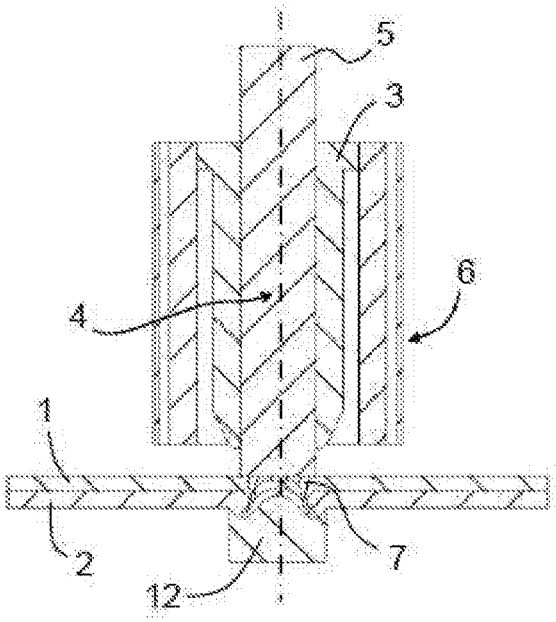
FIG. 12 shows a fourth process step of the third embodiment, wherein the auxiliary joining element penetrates the second component and is deformed in the second component.

The auxiliary joining element is for example a screw, such as a FDS screw. A thread is formed on a shaft of the auxiliary joining element 7, wherein an interlocking connection between the auxiliary joining element 7 and the high-strength first component 1 and the second component 2 is formed in the region of the thread as illustrated in FIG. 8.

In the second embodiment the electric arc 9 is first ignited in order to heat the first component 1 in the region of the heat-affected zone 10. In addition, the electric arc 9 burns during the joining process. The electric arc 9 is thus ignited whilst the auxiliary joining element 7 is guided along the joining axis 4, for example in the combined linear movement in translation and rotary movement, firstly through the first component 1 and then through the second component 2. It can be provided optionally that the electric arc 9 is not ignited continuously during the joining process, but only temporarily and in particular at the start of the joining process. Alternatively, the auxiliary joining element 7 may be guided in translation only.

A third embodiment of the joining method is illustrated in FIGS. 9 to 12. In this third embodiment, the auxiliary joining element 7, which is formed in the manner of a hollow rivet, is associated with a die 12 on a side opposite the first component 1 (i.e. the die faces the second component 2). The die 12 is placed against the second component 2 in the region of the joining areas of the first and second components 1, 2. The electric arc is produced firstly between the non-consumable electrode 3 and the first component 1 during the joining and if the heat-affected zone 10 is formed on the first component 1, the auxiliary joining element 7 is pressed through the high-strength first component 1 and connected to the second component 2 by a further motion of the auxiliary joining element 7 via the joining punch 5 toward the second component 2.

The auxiliary joining element 7 is deformed, so that a seamless connection is created between the first component 1 and the second component 2 with the aid of the auxiliary joining element 7.

Figure 13:
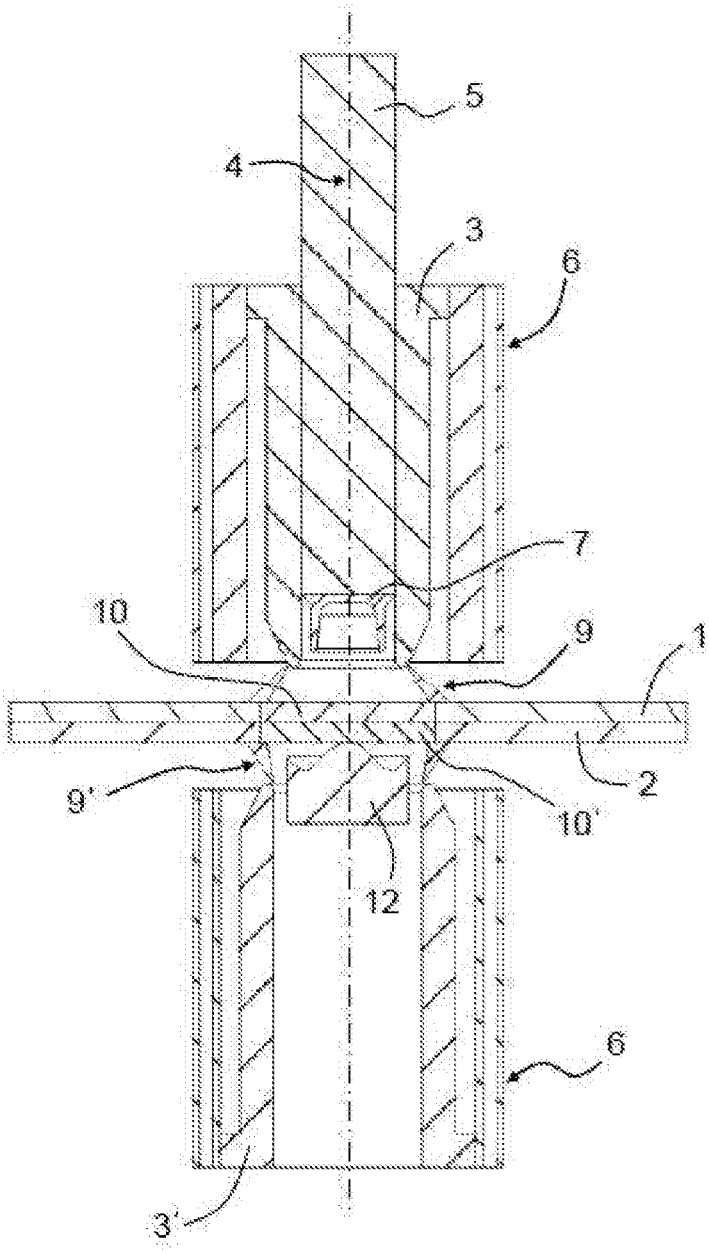
FIG. 13 shows a first step of a method according to a fourth embodiment of the invention, wherein two electric arcs are generated.
Figure 14:
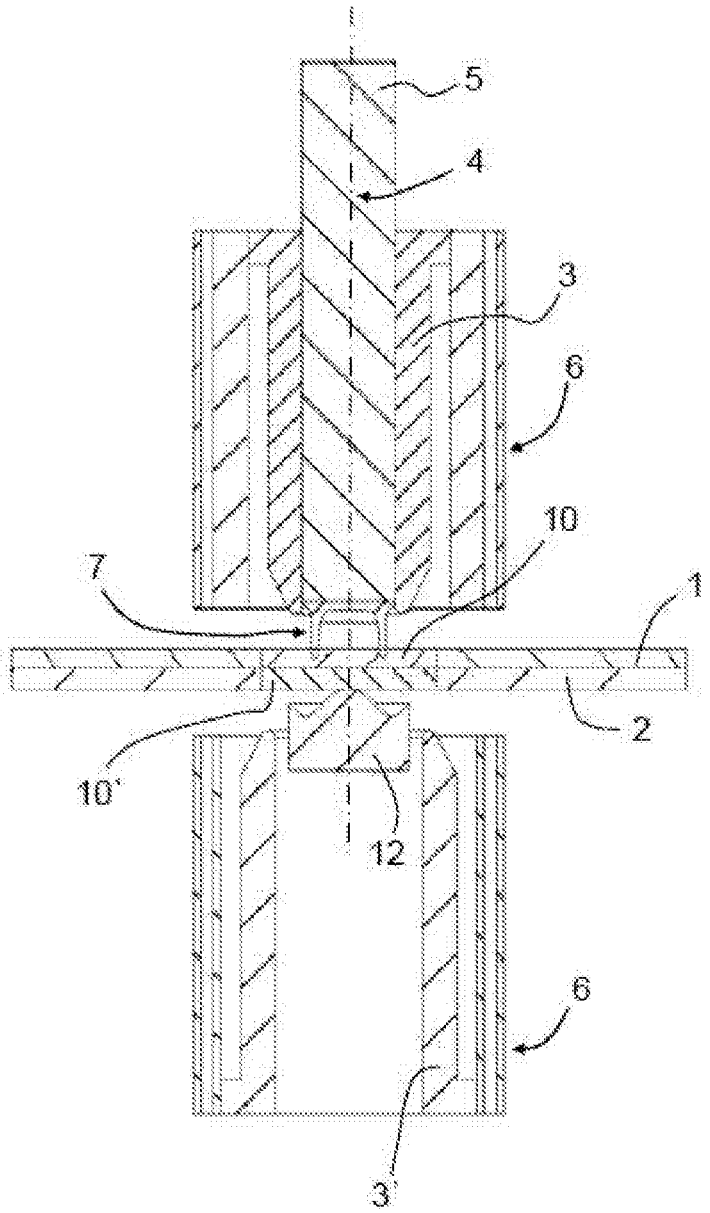
FIG. 14 shows a second step of the fourth embodiment, wherein the die is pressed against the second component.
Figure 15:
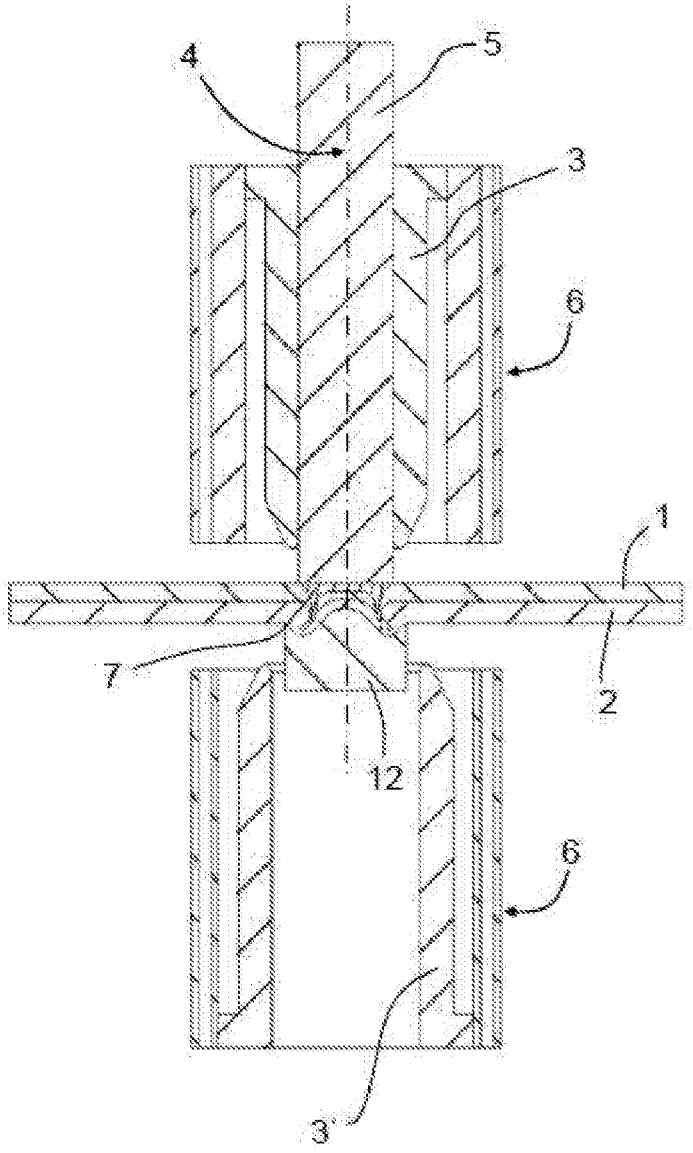
FIG. 15 shows a third process step of the fourth embodiment, wherein the joining is performed.

In a fourth embodiment, illustrated more exactly in FIGS. 13 to 15, a heat-affected zone 10' is also formed on the second component 2, in addition to the first component 1. The second component 2 is associated with a further electrode 3' in order to form the heat-affected zone 10', which further electrode surrounds the die 12 annularly. By means of the first electric arc 9 formed between the electrode 3 and the first component 1 and by means of a second electric arc 9' formed between the second component 2 and the further electrode 3', the first component 1 and the second component 2 are heated in the joining region, so that the strength of the components 1, 2 is reduced or a melt is formed. The auxiliary joining element 7 is then fed via the joining punch 5, and the connection between the first component 1 and the second component 2 is produced by shaping in particular the second component 2 and the auxiliary joining element 7 at the die 12. The electric arcs 9, 9' are extinguished during the production of the connection.

FIG. 16, FIG. 17 and FIG. 18 respectively show further embodiments of the joining method according to the invention, wherein a further joining step is provided to form a welded connection or a solder connection between the components 1, 2.

Figure 16A:
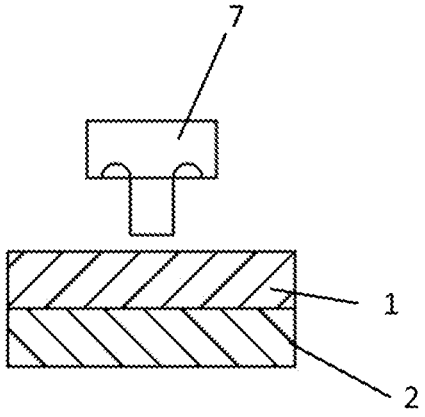
FIG. 16A to FIG. 16E show an embodiment of the joining method according to the invention, wherein a welding connection is provided.

In FIG. 16*a* to FIG. 16, *e*, the auxiliary joining element 7 comprises a shaft connected to a flange. As visible in FIG. 16*a*, the auxiliary joining element 7 is a one-piece element. The surface of the flange facing the shaft comprises an annular groove.

Figure 16B:
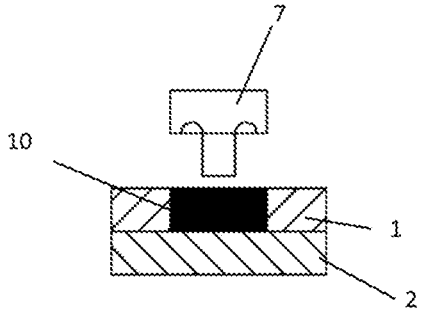

As shown in FIG. 16*b*, the heat-affected zone 10 in the joining area is heated, such that this area is weakened. Such step is not described here in further detail and the method used to heat the heat-affected zone 10 is similar to those described above in reference to FIG. 1 to FIG. 15.

Figure 16C:
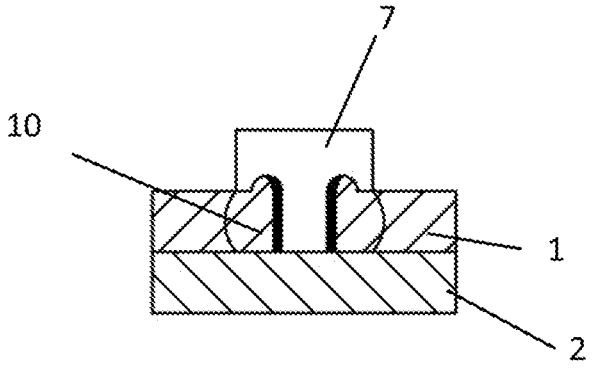
Figure 16D:
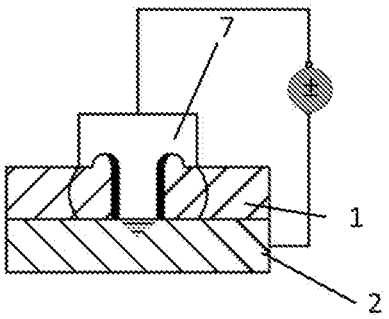

The shaft of the auxiliary joining element 7 penetrates the heat-affected zone 10 and is translated and/or rotated around the joining axis 4 until it contacts the second component 2, as visible in FIG. 16*c*. The material of the first component at least partly fill the groove provided in the flange.

An electrical contact is then arranged between the auxiliary joining element 7 and the second component 2, in order to create a connection or a welding between both component at the point of contact between the shaft and the second component 2.

Figure 16E:
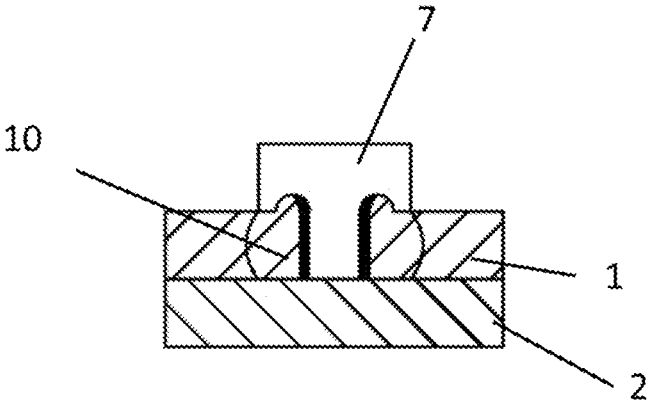

FIG. 16*e* shows the complete joining of the first and second components 1, 2 with the auxiliary joining element 7. A resistant welded joint is thus provided. Thus, the joining is realised by resistance welding.

In FIG. 17*a* to FIG. 17*e*, the method steps are similar to FIG. 16, but the auxiliary joining element 7 comprises a hollow shaft in which a soldering material M is provided. Once the auxiliary joining element 7 has been driven through the first component 1 and contact the second component 2 (see FIG. 17*c*), an electrical contact between auxiliary joining element 7 and second component 2 is realized and the soldering material M allows the solder connection of the components.

Figure 17A:
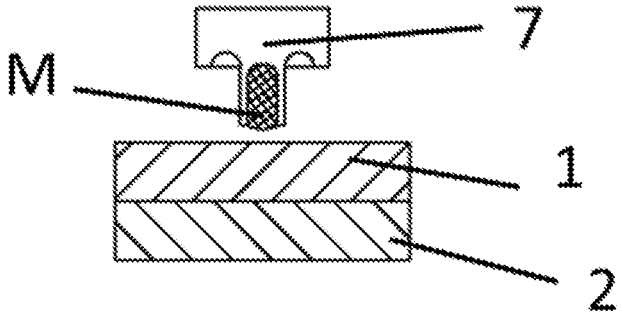
FIG. 17A to FIG. 17E show a further embodiment of the joining method according to the invention, wherein a solder connection is provided.
Figure 18A:
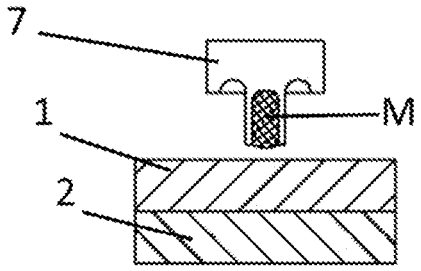
FIG. 18A to FIG. 18C show another embodiment of the joining method according to the invention, wherein another solder connection is provided.
Figure 18B:
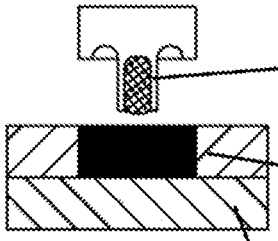
Figure 18C:
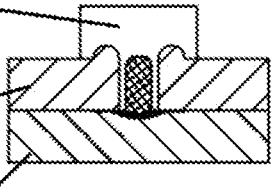

In FIG. 18*a* to FIG. 18*c*, the auxiliary joining element 7 is similar to the one disclosed in FIG. 17*a*, but the step of providing an electrical connection is removed. Indeed, the soldering material M is able to melt in penetrating the heat-affected zone 10 and to contact the second component 2. In other words, the heat provided by the electric arc to form the heat-affected zone 10 is enough to form the solder joint between the components.

Figure 17B:
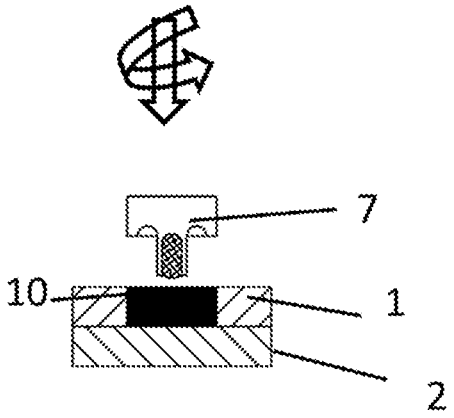
Figure 17C:
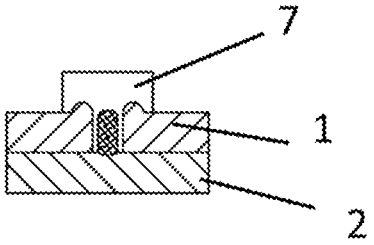
Figure 17D:
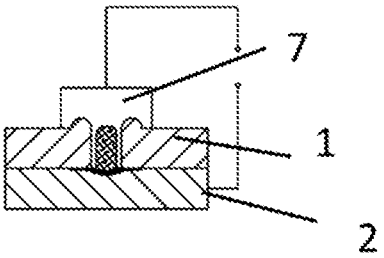
Figure 17E:
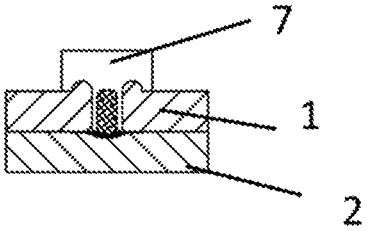

In FIG. 16*b*, FIG. 17*b* and FIG. 18*b*, the auxiliary joining element 7 may be guided in translation along the joining axis and in rotation around said joining axis, in order to better penetrate the first component until contacting the second component.

As previously mentioned, the auxiliary joining element can be a screw, a hollow rivet, more particularly the auxiliary joining element can have a shaft adapted to penetrate the first and second component and a flange adapted to rest against a surface of the first and/or second component. The flange has an outer surface and an inner surface facing the shaft. A coating may be provided on the shaft, and eventually at least partly on the inner surface of the flange in order to allow a better penetration of the material.

The shaft can be provided with a non-constant cross-section, such that the cross-section of the shaft proximate the flange is greater than its distal cross-section. This allows a smooth penetration of the shaft into the first component. For example, the shaft may have substantially the shape of a half-sphere.

The invention is not limited to the presented exemplary embodiments. A person skilled in the art will be able to provide further method variants without departing from the core of the invention. More particularly, the features described in one embodiment may be provided in the other embodiments.

The auxiliary joining element 7 can have a length that makes it possible to connect two components 1, 2 of variable thickness to one another (multi-region joining) and to connect the same first component 1 to different second components 2, which have different thicknesses, using the same auxiliary joining element 7.

It is also possible to connect more than two components using the auxiliary joining element 7. Here, an outer component or both outer components can be heated.

In principle, the electric arc 9, 9' can also be ignited prior to the mechanical connection of the components and optionally additionally also during the insertion of the auxiliary joining element 7.

Two or more joining devices may also be provided and used in parallel to join the first and second component 1, 2 with two or more auxiliary joining element 7 at the same time.

The method according to the invention is not limited to the connection of two or more flat components. In principle, the geometry of the components can be freely selected within wide limits. By way of example, a profiled part can be connected to a sheet material, or two profiled parts can be connected to one another.

Although exemplary embodiments of the present invention have been shown and described, it will be appreciated by those skilled in the art that changes may be made to these embodiments without departing from the principles and spirit of the invention, the scope of which is defined in the appended claims and their equivalents.

What is claimed is:

1. A method for joining at least one component (1) to a second component (2) without a pre-formed hole, the method comprising the steps of:

a. Providing a first and a second component (1, 2), the first and the second components (1, 2) being at least partly positioned one on top of the other, the first component being made in a high-strength material;

b. Providing a joining device and an auxiliary joining element (7), wherein the joining device includes an electrode and a joining punch that is movable along a joining axis;

c. Joining the first and second component together by means of the auxiliary joining element (7), wherein the auxiliary joining element (7) is driven by the joining punch of the joining device toward the first component (1) along the joining axis (4), the auxiliary joining element (7) firstly passing through the first component (1) in the region of a joining area without pre-formed hole and then reaching the second component (2) in the region of the joining area without pre-formed hole; and wherein, prior to the joining, the first component (1) in the region of the joining area is heat-treated via a non-transferred electric arc (9) such that the first component is not part of the electric circuit, the non-transferred electric arc emanating from the electrode (3) provided on the joining device toward the first component in such a way that a heat-affected zone (10) is formed on the joining area of the first component (1), and in that the first component (1) is heated in such a way that a strength of the first component (1) in the heat-affected zone (10) is reduced.

2. The method according to claim 1, wherein the heat-affected zone (10) of the first component (1) is melted by the non-transferred electric arc (9).

3. The method according to claim 1, wherein the non-transferred electric arc (9) is formed annularly around the joining axis (4).

4. The method according to claim 1, wherein the non-transferred electric arc (9) surrounds the auxiliary joining element (7) on an outer lateral side.

5. The method according to claim 1, wherein a protective gas is provided via a protective gas nozzle (6) arranged on the joining device during heat-treating of the first component, and wherein the protective gas nozzle (6) is annular or comprises openings facing the first component (1) at a distance.

6. The method according to claim 1, wherein the auxiliary joining element (7) is moved by the joining punch (5) along the joining axis (4).

7. The method according to claim 1, wherein the auxiliary joining element (7) is rotated around the joining axis (4) during the joining.

8. The method according to claim 1, wherein a die (12) is pressed against the second component (2) in the region of the joining area during the joining, and the die (12) is located coaxially to the auxiliary joining element (7).

9. The method according to claim 1, wherein the electrode (3) is separated from the joining device and is held retained by the auxiliary joining element (7) against at least one of the first or the second component (1, 2) upon moving the joining device away from the auxiliary joining element after completion of the joining.

10. The method according to claim 1, wherein the auxiliary joining element (7) is driven by the joining punch completely through both the first component and the second component (2) such that a free distal end of the auxiliary joining element extends outwardly at the joining area from a side of the first component or the second component that is opposite the joining device.

11. The method according to claim 10, wherein the first component and the second component are completely joined together without requiring access at the joining area to the side of the second component from which the free distal end of the auxiliary joining element extends outwardly.

12. The method according to claim 1, wherein the auxiliary joining element (7) is deformed in the second component (2) and is bent radially outwardly with regard to the joining axis (4).

13. The method according to claim 1, wherein the region of the heat-affected zone (10) is cooled and an integral joining connection is produced between the auxiliary joining element (7) and at least one of the first component (1) or the second component (2).

14. The method according to claim 1, wherein an outer lateral side of the auxiliary joining element (7) includes a pattern, such that a gripping is provided during the joining in the region of the heat-affected zone (10) of the first component (1) or the second component (2) in such a way that a friction or interlocking connection is produced between the first component (1) or the second component (2) on the one hand and the auxiliary joining element (7) on the other hand.

15. The method according to claim 1, wherein the non-transferred electric arc is formed as a plasma arc.

16. The method according to claim 1, wherein the electrode is angularly offset relative to the joining axis.

17. The method according to claim 16, wherein the electrode is angularly offset relative to the joining axis at an angle that is between 10 degrees and 85 degrees.

18. A method for joining at least one component to a second component without a pre-formed hole, the method comprising the steps of:

a. Providing a first and a second component;

b. Providing a joining device and an auxiliary joining element, wherein the joining device includes an electrode, a joining punch, a guide, a protective gas nozzle, and defining a joining axis;

c. Joining the first and second component together by means of the auxiliary joining element, wherein the auxiliary joining element is driven by the joining device toward the first component along the joining axis, the auxiliary joining element firstly passing through the first component in the region of a joining area without pre-formed hole and then reaching the second component in the region of the joining area without pre-formed hole; and wherein, prior to the joining, the first component in the region of the joining area is heat-treated via an electric arc emanating from the electrode provided on the joining device toward the first component in such a way that a heat-affected zone is formed on the joining area of the first component, and in that the first component is heated in such a way that a strength of the first component in the heat-affected zone is reduced; and wherein the first component is made in a high-strength material and is at least partly positioned on top of the second component with the first component positioned closest to the joining device and the second component positioned furthest from the joining device while the joining area of the first component is heat treated prior to the joining and during the joining thereafter; and wherein the joining causes the auxiliary joining element to pass completely through both the first component and the second component such that a free distal end of the auxiliary joining element extends outwardly at the joining area from a side of the second component that is opposite the first component; and wherein the first component and the second component are completely joined together without requiring access at the joining area to the side of the second component from which the free distal end of the auxiliary joining element extends outwardly.

19. The method according to claim 18, wherein the electric arc is formed as a plasma arc.

20. The method according to claim 18, wherein the electric arc is formed annularly around the joining axis.

21. The method according to claim 18, wherein the single electrode is separated from the joining device and is retained by the auxiliary joining element against the first component upon moving the joining device away from the auxiliary joining element after completion of the joining.

22. The method according to claim 18, wherein the electrode is angularly offset relative to the joining axis.

23. The method according to claim 22, wherein the electrode is angularly offset relative to the joining axis at an angle that is between 10 degrees and 85 degrees.

* * * * *